United States Patent [19]

Martin

[11] 3,991,867

[45] Nov. 16, 1976

[54] COIN TESTING AND SEPARATING APPARATUS

[75] Inventor: Bart G. Martin, St. Louis, Mo.

[73] Assignee: Coin Acceptors, Inc., St. Louis, Mo.

[22] Filed: June 13, 1975

[21] Appl. No.: 586,998

[52] U.S. Cl. ..... 194/102

[51] Int. Cl.[2] ..... G07F 3/02

[58] Field of Search ..... 194/102, 99

[56] References Cited

UNITED STATES PATENTS 3,155,214 11/1964 Haverstick ..... 194/102

3,340,981 9/1967 Okolischan ..... 194/102

*Primary Examiner*—Stanley H. Tollberg

*Attorney, Agent, or Firm*—Cohn, Powell & Hind

[57] ABSTRACT

Coin testing and separating apparatus includes a coin cradle and a check lever that impedes movement of the cradle when carrying undersize coins or those having milled edge surfaces, thus preventing such coins from being transferred by the cradle to an acceptance passageway of the apparatus.

7 Claims, 7 Drawing Figures

COIN TESTING AND SEPARATING APPARATUS

BACKGROUND OF THE INVENTION

The present invention relates to improvements in coin testing and separating apparatus of the kind commonly employed in modern vending machines. More particularly the invention pertains to an improved cradle mechanism for testing and separating coins and the like on the basis of size, weight and the milled or unmilled character of their edge surfaces.

The principal object of the present invention is that of improving the efficiency of the cradle mechanism of coin acceptors in discriminating coins which are essentially alike in respects of size, weight and metallic content but differ as to the character of their edge surfaces. An example of coins which have proved to be troublesome in the respect noted is the new English five pence and the German one mark coin. The English coin has a milled edge, whereas the more valuable German coin has a smooth edge.

The object of the present invention is to provide a cradle mechanism that will sense and discriminate coins on the basis of the character of their edge surfaces, and which will perform with improved precision the usual cradle function of testing coins for size and weight before passing them on to an acceptance passageway of the device.

A further object achieved by the present invention is that of preventing an undersized coin from bypassing the cradle, a result which has been known to occur in former devices where the small or undersized coin is forcefully injected in a particular manner into the receiving slot of the acceptor.

Yet another object is to realize the foregoing features and advantages without materially increasing the cost, space requirements or the number of operating parts of the apparatus.

SUMMARY OF THE INVENTION

The coin transfer cradle of an acceptor device is controlled by a check lever that impedes cradle movement when carrying an undersized or a milled edge coin. Only smooth edged coins of proper size will actuate the check lever precisely to a position that will free the cradle from the restraining influences of the check lever.

DESCRIPTION OF THE PREFERRED EMBODIMENT

Figure 1:
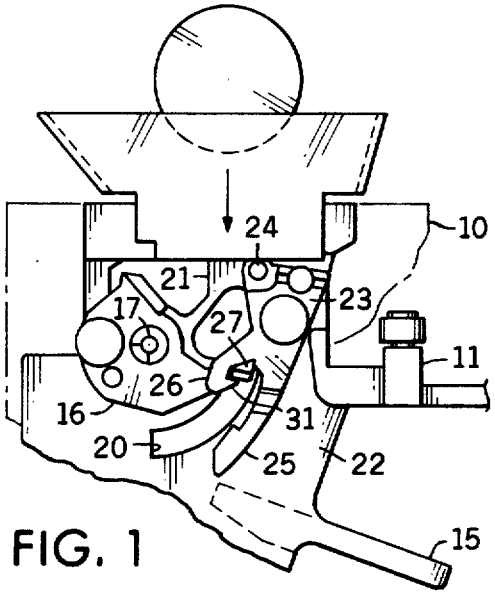
FIG. 1 is a fragmentary, elevational view of the outer side of a frame part, with cradle and latch lever in their normal positions for receiving a coin.
Figure 2:
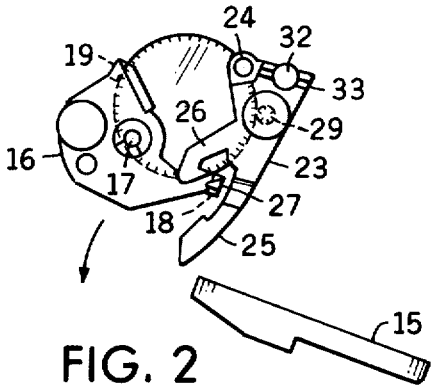
FIG. 2 illustrates the operating parts, as viewed in FIG. 1, shown in retaining engagement with a milled coin.
Figure 4:
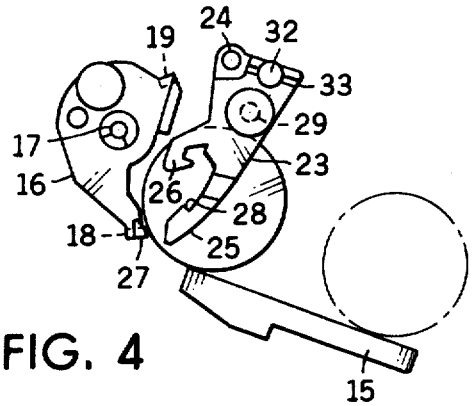
FIG. 4, a view similar to FIG. 2, illustrates the cradle and latch lever in positions for releasing a smooth-edge coin toward an acceptance rail.

With reference to the drawings, 10 designates a fragmentary part of a base plate for a coin acceptor. Mounted on the base plate by hinge means (not shown) is a frame member or gate, a portion of which is indicated at 11. Base plate 10 and gate 11, together with spaced-apart embossments 12 and 13 on the inner side of the gate define a coin entrance passage 14. Also formed on the inner side of gate 11 and spaced below entrance passage 14 is an inclined runway or rail 15 which, in part, defines an acceptance passage.

A cradle member 16, on the outer side of the frame part at a level below the entrance passage and above rail 15 serves to test coins for size, weight and the character of their edge surfaces. If a coin is found to be acceptable in these respects, the cradle will be allowed to tilt and to transfer the coin to the rail for further progress through the apparatus. If the tested coin is oversize, underweight or has a milled edge it will be retained in the cradle until released by scavenging means, not shown, well known in the art.

Cradle 16 is pivotally mounted on a pin 17 adjacent to the outer side of frame 11. The cradle is provided with spaced-apart arms 18 and 19 that project inwardly through openings 20 and 21 in the frame to the opposite or inner side thereof, in position to intercept normal or undersize or oversize coins descending from the entrance passage 14. Coins which are of insufficient size as to be caught by the cradle arms will pass through the space between them, thence through an opening or gap 22 in the rail for passage either to subsequent testing means or to a coin return chute, not shown.

The term "undersized" designates a slightly less diameter than the diameter of the true value coin, while the term "oversized" designates a slightly greater diameter.

As will be understood, a coin of adequate size and weight which is caught by the cradle arms 18-19, will over-balance and tilt the cradle in the general direction of rail 15. Unless the cradle movement is restrained by means subsequently described the cradle will tilt sufficiently to spill the coin onto the rail, whereupon the coin will progress toward an acceptance chute for actuating a vend switch or other means.

Figure 7:
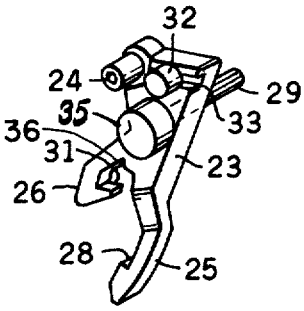
Figure 5:
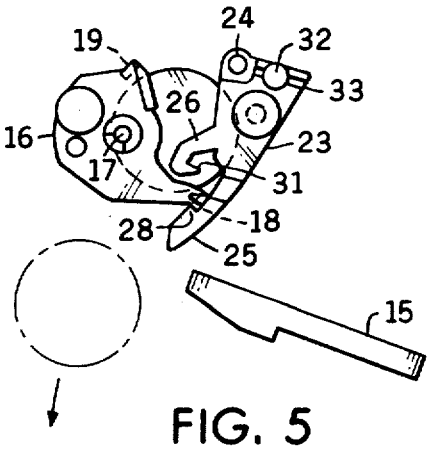
FIG. 5, a view similar to FIG. 2, illustrates the cradle and latch lever passing an undersized coin to a rejection passage.

Numeral 23 (FIG. 7), designates a cradle latch lever which is suspendingly mounted on a pivot pin 24 at an upper corner portion of the lever. The lower end portion of lever 23 is bifurcated to provide spaced leg portions 25 and 26 of unequal length. These leg portions are arranged so as to flank opposite sides of the path of movement of a stud 27 that projects from the outer face of the cradle in substantial alignment with the lower inwardly projecting cradle arm 18. The longer leg 25 of lever 23 is provided with a hook or catch shoulder 28 which normally extends into the path of movement of the cradle arm 18 to limit cradle rotation and prevent the release of a coin carried thereby unless the latch lever is moved to a "cradle-free" position as subsequently described.

Lever 23 is provided with an actuating pin 29 that projects through an opening 30 in the gate. Pin 29 is located on lever 23, in relation to the cradle arms 18 and 19 and to the catch shoulder 28 such that a coin being carried by cradle 16 will make edge surface contact with the pin 29. Pin 29 has a knurled or ridged contact surface or shoulder. A smooth edged coin of proper diameter will slide upon the shoulder of the pin 29 and, acting thereon in the manner of a cam, will swing the lever 23 and its catch shoulder 28 to a point clear of the cradle arm 18, thus allowing the cradle to rotate under the weight of the coin sufficiently to spill the coin therefrom and onto the rail 15. An undersized coin riding on the cradle will fail to cam the lever sufficiently to displace detent shoulder 28 out of the path of movement of the cradle and such a coin will then be retained on the cradle until removed therefrom by suitable scavenging means.

Unlike the sliding action of a smooth edge coin on the knurled pin 29, the ridges of a milled edge coin will interengage the shoulder of the said pin, to prevent movement of the coin and cradle. The milled edge of a proper sized coin, where engaging the shoulder of pin 29 will tend to push the pin 29 down, rather than sidewise, and accordingly the lever 23 will not move and the cradle arm 18 engages the catch shoulder 28 and locks the cradle. The milled coin will be retained on the cradle until released by suitable scavenging means.

The second, shorter leg 26 of lever 23 serves to prevent the check lever 23 from being actuated to a cradle-release position by abnormal movement of an undersized coin in the entrance passage 14, such as has heretofore been known to occur where a small coin has been dropped, or impelled, in the coinreceiving slot in a way to cause it to strike the lower cradle arm 18 and the pin 29 of the latch lever at about the same instant. With the latch lever 23 of the present invention the impact of such an errant small coin against the pin 29 will move the lever in a direction to bring a catch shoulder 31 on lever leg 26 into the path of the cradle stud 27. The cradle will thereby be momentarily prevented from rocking sufficiently to allow the small coin to pass over the lower cradle arm and onto rail 15. In such cases, the coin can now be caught as a normal undersize coin as previously mentioned, and can be released by operation of scavenging means, or the small coin, in some instances, will pass between the cradle arms 18-19 and drop through the gap 22 in rail 15 to a reject chute.

Also, if an undersized coin only hits cradle arm 18, its downward motion could possibly move arm 18 downwardly to a position where the distance between arm 18 and pin 29 is greater than the diameter of the undersized coin, and the undersized coin will then pass between arm 18 and pin 29 and will be deposited on rail 15. To prevent this from happening, the lever 23 is counterbalanced by weight 32. The lever 23 is only prevented from moving under the loading of weight 32 by engagement of cradle stud 27 and lever surface 36. As the small coin strikes arm 18, the arm 18 moves downwardly and causes sharp disengagement of stud 27 and lever surface 36. However, stud 27 strikes catch shoulder 31 to stop further rotation of the cradle and the lever, and the coin is then passed through the gap 22 to a reject chute.

It has been found advantageous to provide means for varying the degree of contact pressure exerted by the shoulder pin 29 against the edge surface of a coin on the cradle. Such is achieved in the present example by the counterweight 32 which is mounted on lever 23 by means of a mounting slot 33. Slot 33 enables the counterweight to be adjusted in a generally horizontal direction toward or away from the pivotal axis 24 of the lever. A fixed counterweight 35 may also be provided.

Figure 3:
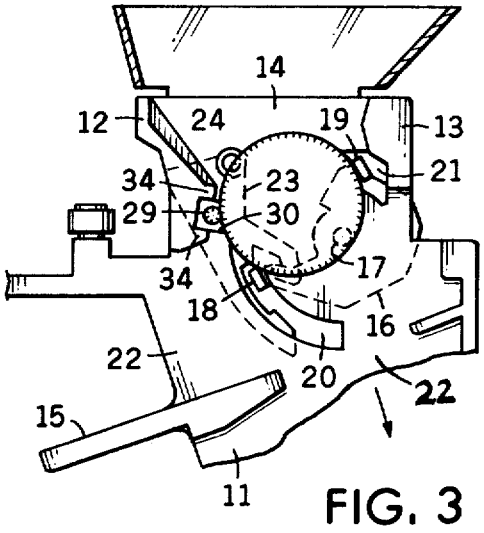
FIG. 3 is a fragmentary side elevational view of the inner side of the frame part, with cradle and latch lever in retaining engagement with a milled coin.
Figure 6:
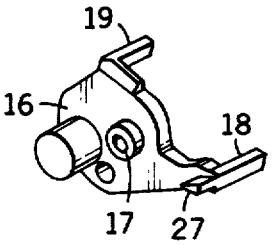
FIGS. 6 and 7 are perspective views of the cradle and latch lever respectively.

The coin-engageable shoulder of the pin 29 is desirably shielded above and below by projections 34 (FIG. 3) on the gate embossment 12, in order to render pin 29 accessible to coins which are being carried toward the pin by the cradle, and relatively inaccessible to an errant coin introduced in an abnormal manner into the apparatus.

I claim as my invention:

1. In coin testing and separating apparatus:

a. a frame having means thereon defining coin acceptance and coin rejection passageways, b. a coin cradle pivotally mounted on said frame for conveying a coin to said acceptance passageway, c. a latch lever pivotally mounted on said frame adjacent said cradle, and d. said latch lever having a first detent means engageable with said cradle to limit cradle movement and prevent the cradle from conveying coins to said acceptance passageway, and a second detent means with a shoulder disposed for contact with the edge of a coin lodged in the cradle, the shoulder of said second detent means making slidable contact with a smooth edged coin of acceptable size in the cradle to displace said first detent means to a non-engaging position with respect to said cradle, and making retaining engagement with a milled edge coin of acceptable size in the cradle to hold the lever and position the first detent means to engage the cradle.

2. In coin testing and separating apparatus:

a. a frame having means thereon defining coin acceptance and coin rejection passageways, b. a coin cradle pivotally mounted on said frame for conveying a coin to said acceptance passageway, c. a latch lever pivotally mounted on said frame adjacent said cradle, d. said latch lever having a first detent means engageable with said cradle to limit cradle movement and prevent the cradle from conveying coins of unacceptable size to said acceptance passageway, and a second detent means disposed for contact with the edge of a coin lodged in the cradle, and e. said second detent means comprising a knurled pin projecting laterally from said latch lever.

3. In coin testing and separating apparatus:

a. a frame having means thereon defining coin acceptance and coin rejection passageways, b. a coin cradle pivotally mounted on said frame for conveying a coin to said acceptance passageway, c. a latch lever pivotally mounted on said frame adjacent said cradle, d. said latch lever having a first detent means engageable with said cradle to limit cradle movement and prevent the cradle from conveying coins of unacceptable size to said acceptance passageway, and a second detent means disposed for contact with the edge of a coin lodged in the cradle, and e. an embossment provided on said frame adjacent said second detent means, said embossment shielding said second detent means from contact with an errant undersized coin.

4. In coin testing and separating apparatus:

a. a frame having means thereon defining coin acceptance and coin rejection passageways, b. a coin cradle pivotally mounted on said frame for conveying a coin to said acceptance passageway, c. a latch lever pivotally mounted on said frame adjacent said cradle, d. said latch lever having a first detent means engageable with said cradle to limit cradle movement and prevent the cradle from conveying coins of unacceptable size to said acceptance passageway, a second detent means disposed for contact with the edge of a coin lodged in the cradle, and a third detent means disposed in spaced opposition to said first detent means, and e. said cradle including a keeper stud projecting therefrom, susceptible of engagement by said third detent means.

5. Coin apparatus as defined in claim 4, wherein:

a. said first and third detent means on said latch lever are spaced unequal distances from the pivotal axis of said latch member.

6. Coin apparatus as defined in claim 4, wherein:

a. biasing means is provided acting on said latch lever, tending normally to position said lever with said third detent means disposed for engagement with said cradle keeper stud.

7. Coin apparatus as defined in claim 6, wherein:

a. said biasing means includes a counterweight adjustably mounted on said latch lever.

* * * * *